US007500837B2

(12) United States Patent
Miyagi et al.

(10) Patent No.: US 7,500,837 B2
(45) Date of Patent: Mar. 10, 2009

(54) SMALL SIZE GEAR PUMP

(75) Inventors: Naoki Miyagi, 571-3, Niiharu-cho, Midori-ku, Yokohama-shi, Kanagawa (JP) 226-0017; Fujio Yamamoto, Fukui (JP); Yuichi Murai, Sapporo (JP); Koji Miyazaki, Fukui (JP); Futoshi Matsui, Fukui (JP); Yuji Aoyagi, Fukui (JP)

(73) Assignees: Naoki Miyagi, Kangawa (JP); Fukui Prefecture, Fukui (JP); Japan Aerospace Exploration Agency, Tokyo (JP)

( * ) Notice: Subject to any disclaimer, the term of this patent is extended or adjusted under 35 U.S.C. 154(b) by 621 days.

(21) Appl. No.: 10/885,239

(22) Filed: Jul. 7, 2004

(65) Prior Publication Data

US 2005/0042124 A1 Feb. 24, 2005

(30) Foreign Application Priority Data

Jul. 7, 2003 (JP) ..... 2003-193044

(51) Int. Cl.
*F01C 1/02* (2006.01)

(52) U.S. Cl. ..... 418/61.3; 418/109; 417/371; 417/420

(58) Field of Classification Search ..... 417/410.4, 417/371, 420, 357, 410.3; 418/61.3, 171, 418/170, 166
See application file for complete search history.

(56) References Cited

U.S. PATENT DOCUMENTS 2,190,246 A * 2/1940 Schirmer ..... 417/370
2,309,683 A * 1/1943 Wahlmark ..... 417/360
2,782,720 A * 2/1957 Dochterman ..... 417/357
3,767,330 A * 10/1973 Signorile ..... 417/420
3,791,765 A * 2/1974 Hansen ..... 417/357
3,895,888 A * 7/1975 Roberts ..... 418/61.3
4,225,292 A * 9/1980 Hallerback et al. ..... 417/367
5,145,348 A * 9/1992 Zumbusch ..... 418/171
5,181,837 A * 1/1993 Niemiec ..... 417/350
5,263,829 A * 11/1993 Gergets ..... 417/420
5,407,331 A * 4/1995 Atsumi ..... 417/420
5,569,024 A * 10/1996 Dummersdorf et al. ..... 417/420
6,129,176 A * 10/2000 Hunsberger et al. ..... 181/202

FOREIGN PATENT DOCUMENTS

| | | |
|---|---|---|
| JP | 62-102886 | 6/1987 |
| JP | 08-159044 | 6/1996 |
| JP | 8-219020 | 8/1996 |
| JP | 09-037504 | 2/1997 |
| JP | 2002-276658 | 9/2002 |

OTHER PUBLICATIONS

Translation of Japanese Office Action mailed Sep. 16, 2008, in JP 2003-193044.

* cited by examiner

*Primary Examiner*—Charles G Freay
*Assistant Examiner*—Peter J Bertheaud
(74) *Attorney, Agent, or Firm*—Banner & Witcoff, Ltd.

(57) ABSTRACT

A small size gear pump having a disc-shaped case, inside which a flat cylindrical motor rotor chamber, a bearing chamber and a flat cylindrical gear chamber are arranged eccentrically from the bearing chamber and the rotor chamber, which are piled sequentially along an axial direction and are communicating to each other.

13 Claims, 7 Drawing Sheets

SMALL SIZE GEAR PUMP

BACKGROUND OF THE INVENTION

The present invention relates to a small size gear pump used for equipments and systems such as a cooling system used for electronic devices, medicine feeding system used in medical field such as artificial dialysis, medicine delivery system for chemical related equipments etc., which are required to have a small and a thin package size.

Generally, in heat exchange system, water, alternative chlorofluorocarbon, alcohol kind, glycol kind, or ammonia are used as a heat medium. Pumps feeding such heat media are classified as a turbo type pump of an axial flow type or of a centrifugal type having a constant pressure and a volume type pump of a rotary type or of a reciprocating type having a constant volume. However, the conventional pumps have such draw backs as having a large size, having an insufficient suction efficiency or having high electric power consumption.

Recent electronic devises generate an extremely lot of heat in accordance with high density or high integration as seen in highly integrated circuits (IC, LSI). As a result, a system which cools with a liquid heat medium having a high heat exchange capacity is required because the conventional air cool system is not enough to cope with the demand. In the present cooling system, the pump for feeding the liquid heat medium is required to be small in size and be thin in thickness as well as to have a high efficiency and low electric power consumption, so that it may be mounted in a case of an electronic device.

As such a small size pump, one having a trochoid gear in a main body of the pump is proposed. (For example, refer to Japanese Patent Publication 2002-276658.)

In the small size pump, a motor rotates the inner gear composing the trochoid gear to shift a space generated between the inner gear and an outer gear along a rotating direction and thereby to transport a fluid in the space to a prescribed direction.

The small size pump mentioned above, however, has generally a cylindrical configuration, in which the inner gear of the trochoid gear is directly connected with the rotation shaft of the motor. In general, a cylindrical pump is apt to generate a wasted space around the place where it is installed, which provides a poor space utility.

There is therefore a room for improvement in the conventional small size pump, which drives a trochoid gear with a motor, from the view point of the space efficiency.

BRIEF SUMMARY OF THE INVENTION

According to an embodiment of the present invention, a small size gear pump is provided, in which there is no waste space around the place where it is installed, and in which a good space utility is provided. More specifically, the small size gear pump has a disc-shaped case, inside which a flat cylindrical motor rotor chamber, a bearing chamber and a flat cylindrical gear chamber are arranged eccentrically from the bearing chamber and the rotor chamber, which are piled sequentially along an axial direction and are communicating to each other.

The disc-shaped case has a suction port and a discharge port, which make the motor rotor chamber and the gear chamber to be communicated to outside of the case respectively.

A rotating shaft is provided at a center portion of the motor rotor chamber in the disc-shaped case. An end of the rotating shaft is supported in radial direction and in thrust direction by a first bearing provided on the center portion of a bottom of the motor rotor chamber. The rotating shaft is also supported by a second bearing in radial direction at an intermediate portion along the axial direction. The other end of the rotating shaft is extended into the gear chamber.

In the motor rotor chamber, there are provided a disc-shaped rotor, which is integrally provided around the rotation shaft and a stator, which is provided on the bottom of the motor rotor chamber and composes a motor with the motor rotor.

In the gear chamber, there is provided a trochoid gear, which is composed of an outer rotor and an inner rotor. The inner rotor is connected with the other end of the rotation shaft. With rotation of the trochoid gear, a fluid is introduced into the case through the suction port and is discharged from the case through discharge port.

Further, according to an embodiment of the present invention, the first bearing is composed of a radial bearing portion and a thrust bearing portion. The radial bearing portion has a concave portion formed on the bottom of the motor rotor chamber, in which the end of the rotating axis is inserted. The thrust bearing portion is formed on a surface around the concave portion for contacting with an under surface of a center portion of the motor rotor around the rotating axis and for rotating them thereon.

Further, according to an embodiment of the present invention, an axis spacer is integrally provided at the other end of the rotating axis extending to the gear chamber. The axis spacer has a cross section larger than that of the rotating axis. The axis spacer has a flat side surface and a curved side surface. A coupling hole is formed at a center portion of the inner rotor in the gear chamber. The axis spacer inserted into the coupling hole, thereby transmitting a rotating force of the rotating axis to the inner rotor and controlling a rotating attitude.

Further, the flat side surface and the curved side surface of the axis spacer are in contact with a inner wall of the coupling hole formed at the center portion of the inner rotor.

Further, according to another embodiment of the present invention, the flat side surface of the axis spacer is formed by a pair of parallel flat side walls facing to each other and the curved side surface of the axis spacer is formed by a pair of side walls coupling the pair of parallel side walls.

Further, according to other embodiment of the present invention, the curved side surface of the axis spacer is formed by a substantially semispherical surface.

Further, according to other embodiment of the present invention, the stator is provided with a metal core board and the motor rotor is provided with a permanent magnet, thereby pulling the rotation shaft toward the thrust bearing by a magnetic attractive force produced between the metal core and magnet of the rotor.

Further, according to other embodiment of the present invention, amorphous carbon, resin or other material, which is excellent in sliding ability, wear resistance or chemical resistance, is used for the inner rotor and outer rotor of the trochoid gear, or for contact portions between the first or second bearing and the rotation shaft.

Further, according to other embodiment of the present invention, it is preferable to use resin O-ring, resin gasket or metal gasket on the portion where seal is needed.

Further, according to other embodiment of the present invention, it is preferable to use silicon steel plate of low iron loss for a metal core base plate of the stator.

Further, according to other embodiment of the present invention, a base plate of the disc-shaped case may be fastened together with the metal core base plate of the stator for reinforcement, in case the inner pressure of the pump is 1 MPa or higher.

Further, according to other embodiment of the present invention, it is preferable to fill a high heat conduction material between the outer surface of the bottom plate of the motor rotor chamber and a coil wire arranged on the stator.

According to other embodiment of the present invention, the disc-shaped case is composed of a motor case, a bearing case and a gear case. The motor case has a flat and disc-shaped concave portion for providing a rotor chamber on its upper surface. The motor case further has the first bearing at a center portion of its bottom and another concave portion for mounting the stator on the outer surface of its bottom. The bearing case is integrally mounted on the motor case through a seal member. The second bearing is provided at the center portion of the bearing case coaxially with the first bearing. The gear case is integrally mounted on the bearing case through a seal member. The gear case has a flat cylindrical shape having an eccentric axis with the rotor chamber. An upper lid is integrally assembled on the gear case through a seal member for covering the upper surface of the gear chamber. A bottom plate of the disc-shaped case is provided on the outer surface of the bottom of the motor case for covering the stator.

According to the embodiments described above, the small size gear pump is provided having high space efficiency without generating a wasted space around the place where it is installed by employing a flat and disc-shaped outer configuration.

Further, a trochoid gear pump is provided, which has a long life and few frequency of parts replacement since it has an enough mechanical strength and since it makes use of the operating fluid as lubricant.

DETAILED DESCRIPTION OF THE INVENTION

An embodiment of the small size gear pump according to the present invention is explained in detail referring to the figures appended.

Figure 1:
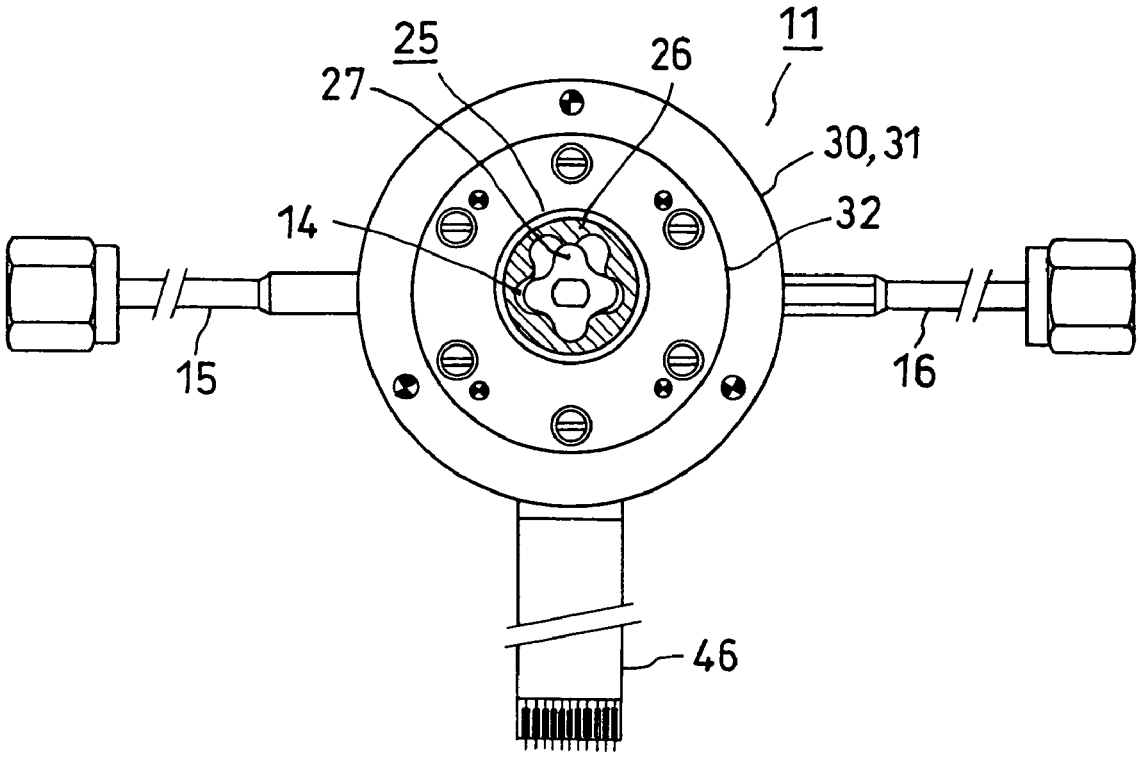
FIG. 1 is a plan view showing a small size gear pump according to an embodiment of the present invention.
Figure 2:
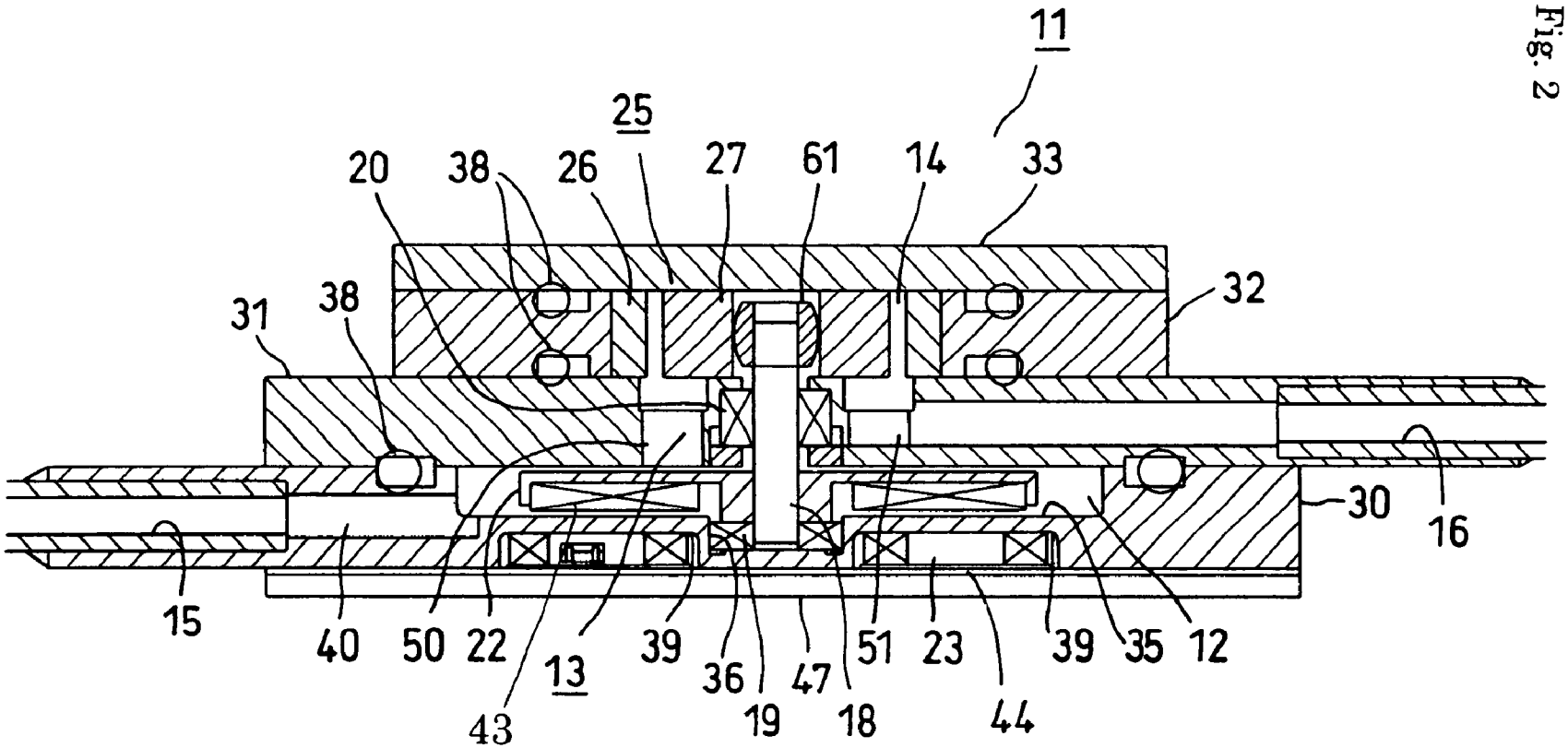
FIG. 2 is a cross section showing an inside portion of the case shown in FIG. 1 with an enlarged view.

FIG. 1 is a plan view showing a whole configuration of a small size gear pump according to an embodiment of the present invention and FIG. 2 is a cross section showing main portion of the small size gear pump shown in FIG. 1 with an enlarged view. Here, FIG. 1 is a plan view in which an upper lid described later is removed.

As shown in the figures, a case 11 has nearly circular disc-shape configuration, in which a rotor chamber 12, a bearing chamber 13 and a gear chamber 14 are piled sequentially from the lower side of the case 11 to upward along the axial direction of the case 11. The rotor chamber 12 and the gear chamber 14 have a flat cylindrical shape respectively and they are communicating with each other through the bearing chamber 13, the detailed compositions of which will be explained later. The axial center of the gear chamber 14 is arranged eccentrically from the axial center of the rotor chamber 12, as explained later. Besides, a suction pipe 15 and a discharge pipe 16 are connected with the case 11, which make the rotor chamber 12 and the gear chamber 14 communicate with outside of the case 11 respectively.

A rotation shaft 18 is provided at a center portion of a bottom of the rotor chamber 12. An end (lower end in the figure) of the rotation shaft 18 is supported by a first bearing 19 in a radial direction and in a thrust direction. The rotation shaft 18 is also supported around an outer periphery of an intermediate portion along its longitudinal axis in radial direction by a second bearing 20 provided in the bearing chamber 13. Further, the other end of the rotating shaft 18 (upper end in the figure) is extended to inside the gear chamber 14. The first bearing 19 and the second bearing 20 are sliding bearings, which receive the rotation shaft 18 with a flat surface or an inner wall.

A rotor 22 having a disc-shape is integrally fixed around the axis of the rotation shaft 18 in the rotor chamber 12. A stator 23 is provided on an outer surface of the case 11 across the bottom plate of the rotor chamber 12 and provides the rotor 22 with a magnetic rotation force. That is, the rotor 22 and the stator 23 constitute a motor.

A trochoid gear 25 consists of an outer rotor 26 provided in the gear chamber 14 and an inner rotor 27 connected with the other end of the rotation shaft 18, which gives rise to a pump function.

The trochoid gear pump takes in a fluid through suction pipe 15 and discharges it from the discharge pipe 16 by the rotation of the trochoid gear 25.

Each portion will be explained below in more detail.

The case 11 consists of a motor case 30, a bearing case 31, a gear case 32, and an upper lid 33 as shown in FIG. 2.

Figure 3:
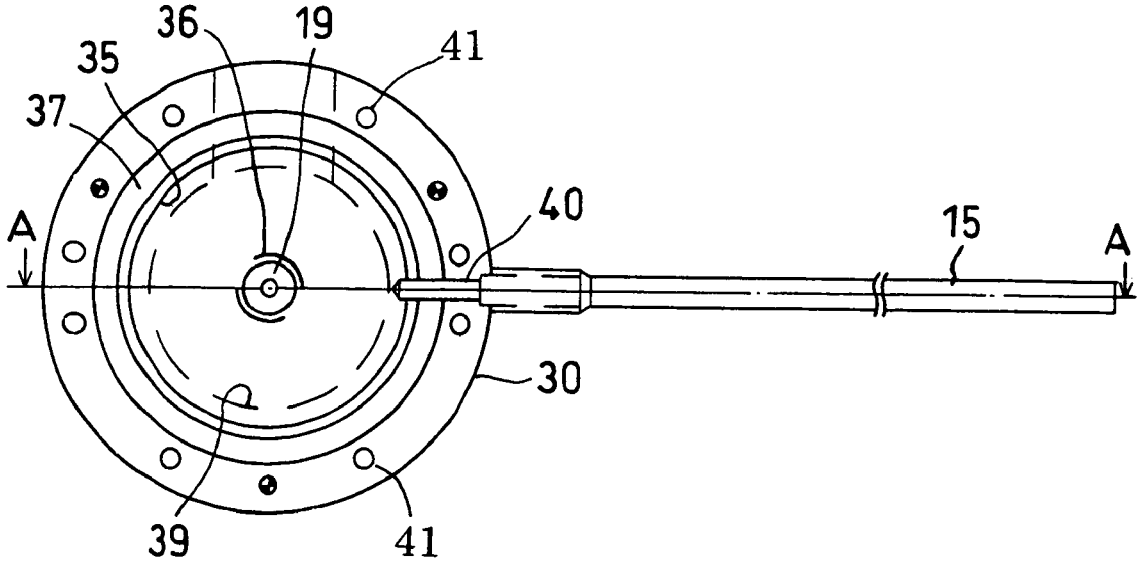
FIG. 3 is a plan view of a motor case shown in FIG. 2.
Figure 4:
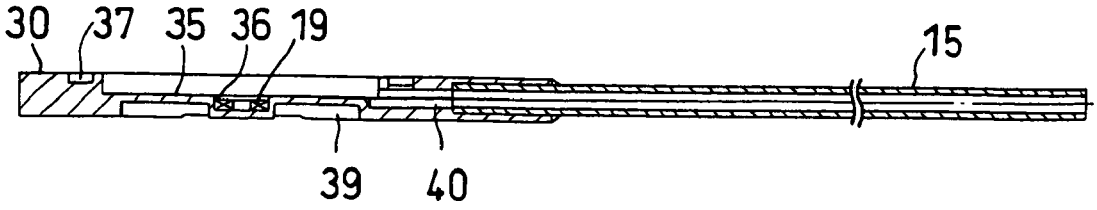
FIG. 4 is a cross section along A-A shown in FIG. 3.

The motor case 30 has a circular disc-shape as shown in FIG. 3 and FIG. 4, on an upper portion of which a flat cylindrical concave portion 35 is formed. The concave portion 35 is used for a rotor chamber 12 as shown in FIG. 2. The concave portion 35 has another concave portion 36 having a smaller diameter than the concave portion 35 at a center portion of the bottom area of the concave portion 35. A first bearing 19 is provided in the concave portion 36.

On the upper portion of the motor case 30, a ring shape groove 37 is formed so as to surround the concave portion 35. In the groove 37, an O-ring 38 is attached as shown in FIG. 2. Further, a concave portion 39 for mounting a stator 23 is provided on the outer surface of the bottom portion of the motor case 30.

Further, a communicating path 40 is formed in the motor case 30, which extends in radial direction from the bottom of the concave portion 35. A suction pipe 15 is connected with the communicating path 40, which functions as a suction port. Namely, the concave portion 35 (it is used for the rotor chamber 12 after assembled) is communicating with outside of the case 11 through the suction port (communicating path) 40 and suction pipe 15.

Further, a plurality of holes 41 for vertical connection is provided on a top of the motor case 30, as shown in FIG. 3.

Figure 5:
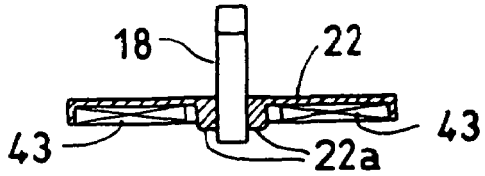
FIG. 5 is a cross section of a rotor shown in FIG. 2.
Figure 6:
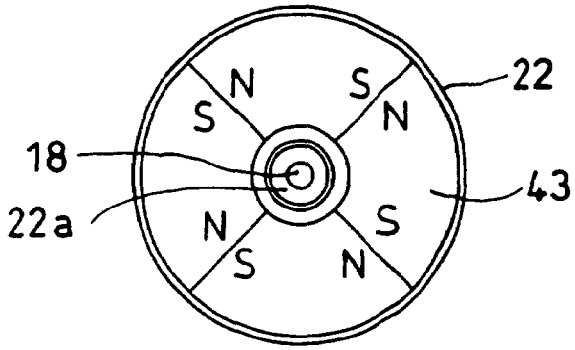
FIG. 6 is a bottom plan view of the rotor shown in FIG. 2.
Figure 7:
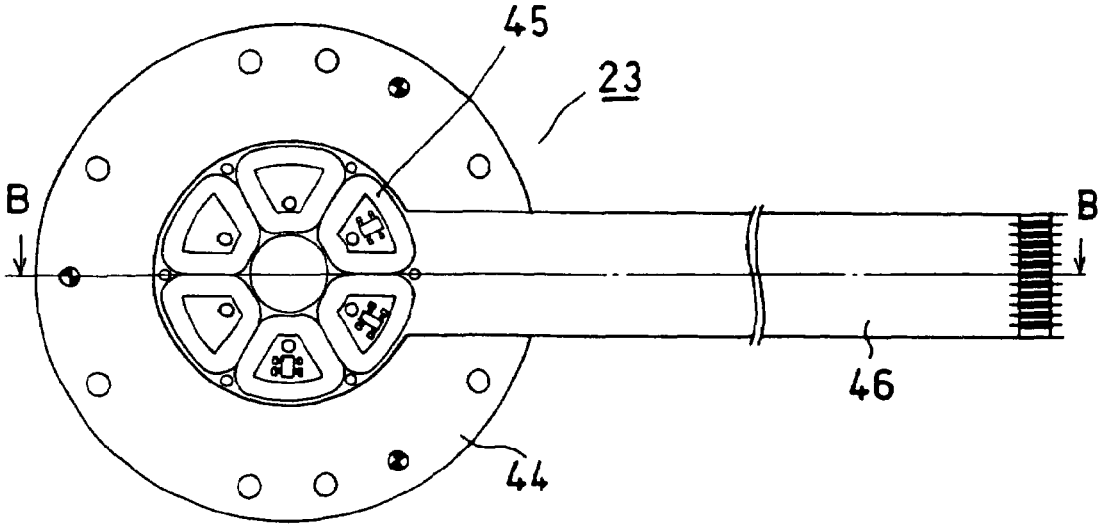
FIG. 7 is a plan view showing a stator shown in FIG. 2.
Figure 8:
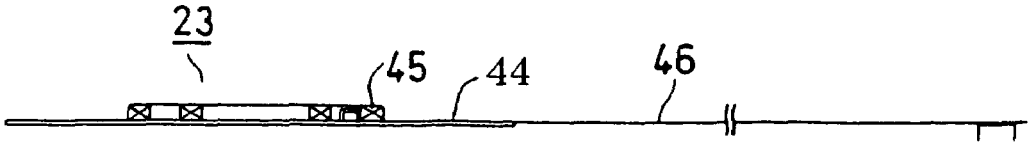
FIG. 8 is a cross section along B-B shown in FIG. 7.

The rotor 22 provided in the concave portion 35 (rotor chamber 12) of the motor case 30 is integrally fixed around the lower portion of the rotation shaft 18 as shown in FIG. 5. A magnet 43 such as a permanent magnet is attached integrally on the lower surface of the rotor 22 as shown in FIG. 6. The lower surface 22*a* of the coupling portion of the rotor 22 around the rotation shaft 18 is so placed as to be rotated on the upper surface of the first bearing 19 as shown in FIG. 22. Further, the lower portion of the rotation shaft 18 is inserted into the first bearing 19 so as to be rotated freely. That is, the rotor 22 and the rotation shaft 18 are supported both in the thrust direction and the radial direction by the first bearing 19. Therefore, the first bearing 19 is called as a thrust-radial compound bearing. The first bearing 19 is a sliding bearing having a flat portion, which is in contact with an under surface 22*a* of the coupling portion of the rotor 22 around the rotation shaft 18, and a concave portion for receiving the rotation shaft 18, which is in contact with the outer surface of the rotation shaft 18 at an inner wall of the first bearing 19.

Referring to FIG. 2, the stator 23 provided in the concave portion 39 formed on the outer surface of the bottom portion of the motor case 30, has a metal core 44 and a coil wire 45 formed on the metal core base plate 44. Besides, a belt-shape flexible base plate 46 is provided in the stator 23, which is connected with the coil wire 45 and with an outside circuit by the flexible base plate 46.

A silicon steel plate with low iron loss is used for the metal core base plate 44A, which is attached integrally to the outside surface of the bottom portion of the motor case 30 together with a reinforce plate 47 with the coil wire 45 being placed inside the concave portion 39. The stator 23 thus assembled gives magnetic rotation force to the rotor 22 through the bottom plate of the motor case 30, thereby drive the rotor 22. Besides, the rotation shaft 18 is supported in the thrust direction by the magnetic attracting force generated between the metal core base plate 44 and the magnet 43 of the rotor 22.

Here, a high heat conduction material such as silicone resin is filled between the outer surface of the bottom plate (the bottom surface of the concave portion 39) of the motor case 30 and the coil wire 45.

The bearing case 31 forming the bearing chamber 13 is integrally mounted on the motor case 30 with an O-ring 38 interposed there between. A second bearing 20 is integrally mounted on the bearing case 31 at a center portion thereof by a bearing press member 49. The second bearing 20 is a friction bearing located coaxially with the first bearing 19 and supports the rotation shaft 18 in the radial direction at the intermediate portion thereof so that the rotation shaft 18 is freely rotated around its axis.

Figure 9:
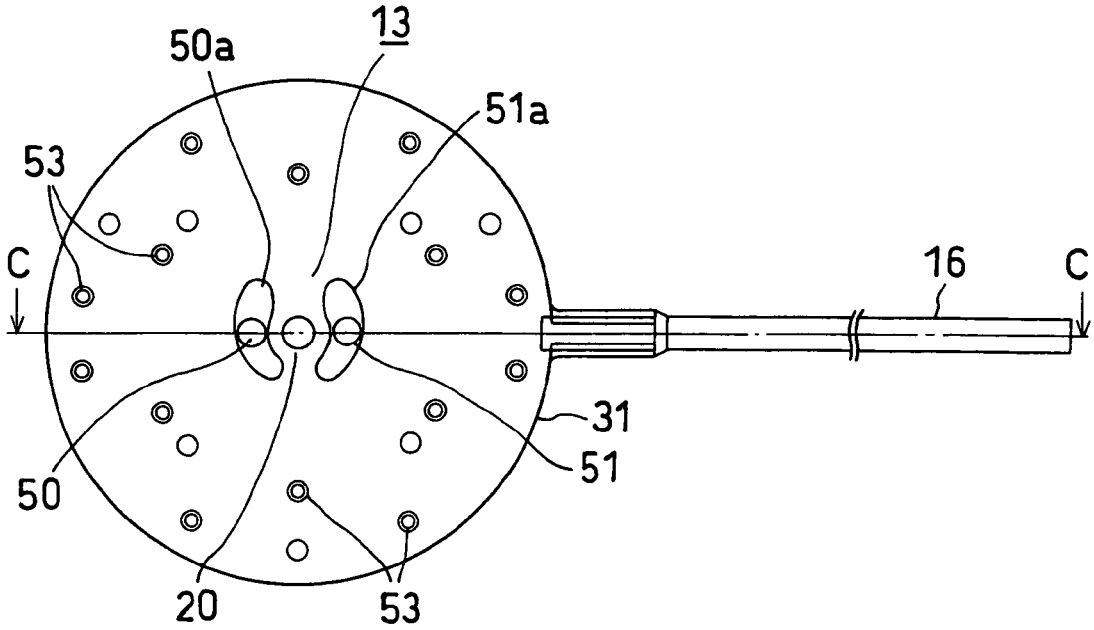
FIG. 9 is a plan view showing a bearing case shown in FIG. 2.

A vertical communicating hole 50 and outside communicating hole 51 are provided around the second bearing 20 of the bearing case 31 as shown in FIG. 9. On the upper ends of the vertical communicating hole 50 and the outside communicating hole 51, arc shape concave portions 50*a*, 51*a* are eccentrically formed around the center axis. The vertical communicating hole 50 connects the lower rotor chamber 12 and the upper gear chamber 14. Also, the outside communicating hole 51 is folded along radial direction in the bearing case 31 and is connected with discharge pipe 16. Namely, the outside communicating hole 51 functions as a discharge port, which connects the upper gear chamber 14 with outside together with discharge pipe 16.

Figure 10:
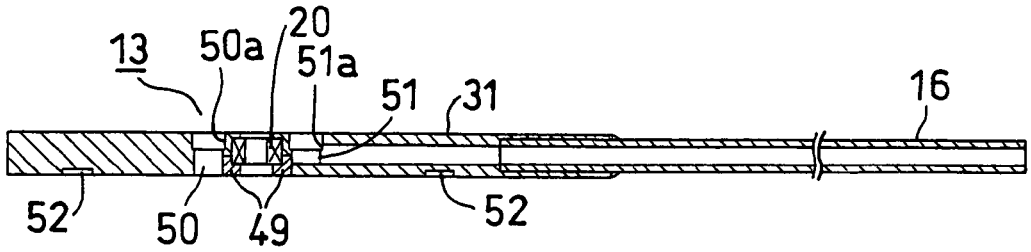
FIG. 10 is a cross section along C-C shown in FIG. 9.

Further, a ring shape groove 52 for O-ring 38 is formed on the lower surface of the bearing case 31 as shown in FIG. 10, and a plurality of screw holes 53 for vertical connection are formed on the board as shown in FIG. 9.

Figure 11:
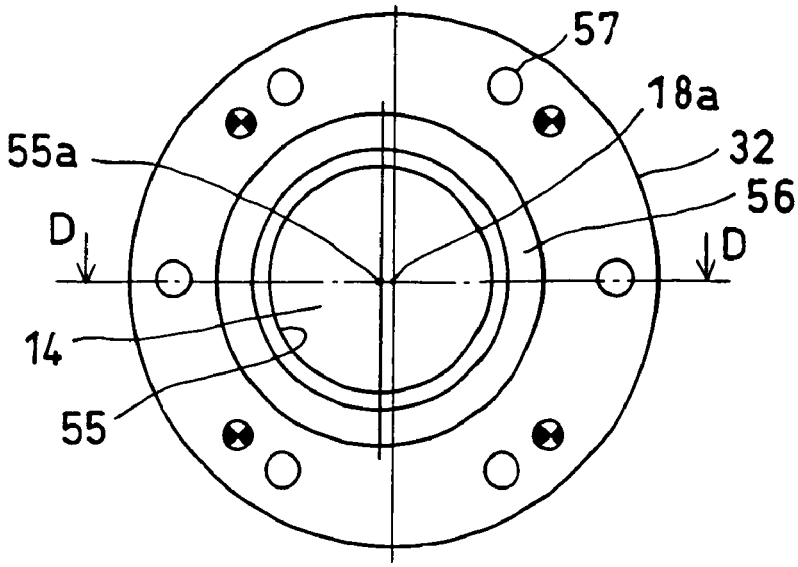
FIG. 11 is a plan view showing a gear case shown in FIG. 2.
Figure 12:
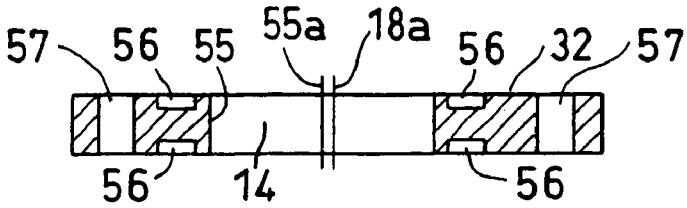
FIG. 12 is a cross section along D-D shown in FIG. 11.

A gear case 32, which forms the gear chamber 14, is integrally assembled on the bearing case 31 through O-ring 38. The gear case 32 has a cylindrical opening 55 which is penetrating vertically to form the gear chamber 14 as shown in FIG. 11 and FIG. 12. The cylindrical opening 55 is formed in a way as the axial center 55*a* is eccentric with the axial center 18*a* (also the axial center of the rotor chamber 12) of the rotation shaft 18.

Ring shape grooves 56 for O-ring 38 are provided on the upper surface and the lower surface of the gear case 32, and a plurality of through holes 57 for vertical connection are provided on a board around the cylindrical opening 55. A n upper lid 33 is assembled integrally on the upper surface of the gear case 32 with an O-ring 38 interposed there between to cover the upper surface of the gear chamber 14 as shown in FIG. 2.

Referring to FIG. 2, a trochoid gear 25, which functions as a pump, is provided in the gear chamber 14. The trochoid gear 25 is composed of an outer rotor 26 and an inner rotor 27.

Figure 13:
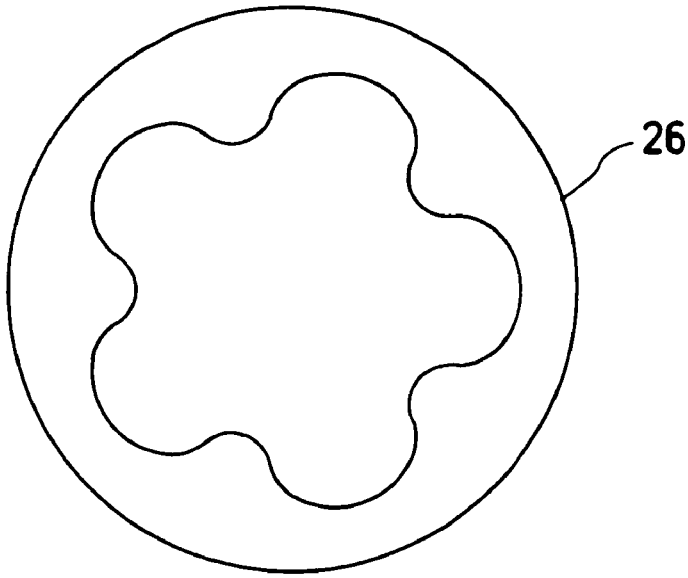
FIG. 13 is a plan view showing an outer rotor of the trochoid gear shown in FIG. 2.

The outer rotor 26 has an outer diameter which can fit in the gear chamber 14 and tooth profile of trochoid curve is formed on the inner periphery as shown in FIG. 13, which is so coupled in the gear chamber 14 as to be freely rotated.

Figure 14:
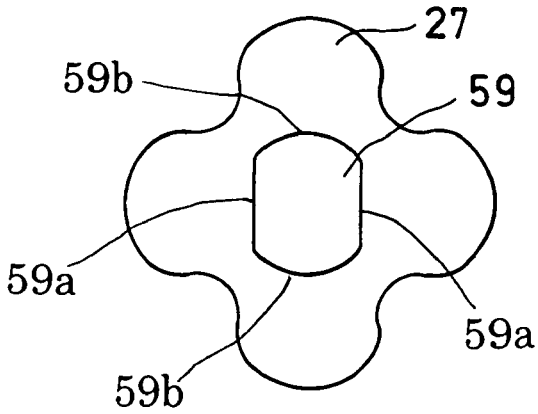
FIG. 14 is a plan view showing an inner rotor of trochoid gear shown in FIG. 2.

The inner rotor 27 is provided in the outer rotor 26 and composes the trochoid gear 25 together with the outer rotor 26. The inner rotor 27 is connected with the other end of the rotation shaft (upper end in the figure) and receives rotation force from the rotation shaft 18. As shown in FIG. 14, the inner rotor 27 has a tooth profile of trochoid curve formed on the outer periphery and has a coupling hole 59 formed at its center portion for transmitting a rotation force. The coupling hole 59 has a inner surface composed of a pair of parallel flat walls 59*a*, 59*a* and a pair of curved surfaces 59*b*, 59*b* connecting the surfaces 59*a*, 59*a* as shown in FIG. 14. The upper end of the rotation shaft 18 where a shaft spacer 61 described later is coupled is inserted into the coupling hole 59 of the inner rotor 27, thereby transmitting the rotating force of the rotation shaft 18 to the inner rotor 27 as shown in FIG. 2.

Figure 15:
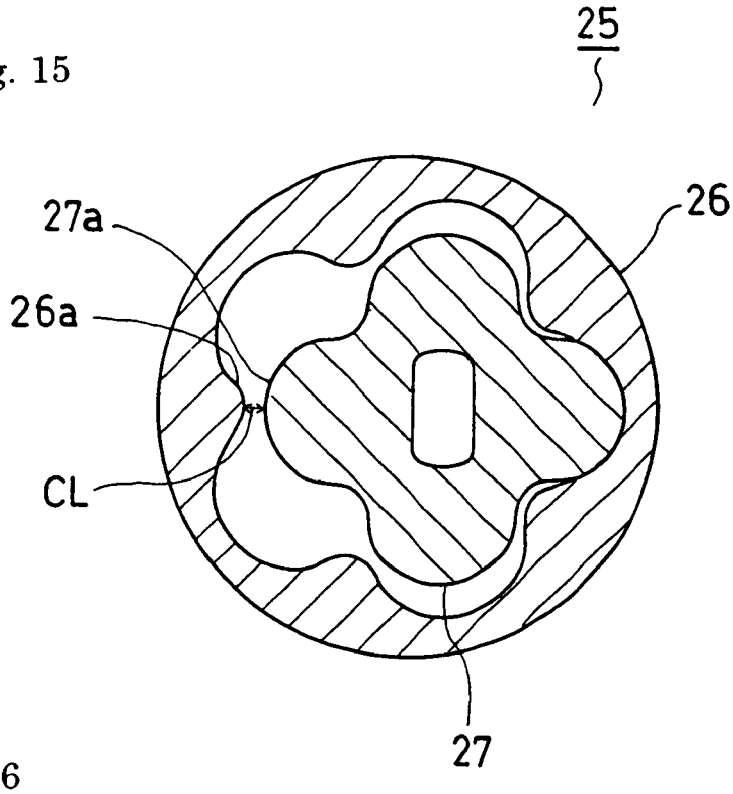
FIG. 15 is a plan view showing the trochoid gear shown in FIG. 2.

The outer rotor 26 and the inner rotor 27 thus constructed are combined as a trochoid gear having pump function as described above, where a clearance CL is provided between inner periphery top 26*a* of outer rotor 26 and outer periphery top of the inner rotor 27 as shown in FIG. 15. The clearance CL is so selected as a clearance ratio to the base radius of the inner rotor 27 as to be 0.001 or higher.

Here, the outer rotor 26 and the inner rotor 27 are in contact with each other at an only one point on the right hand of FIG. 15, and the clearance CL is provided at the opposite side of the contact point. The reason why the clearance CL is provided will be explained below.

When two gears 26, 27, having different angular velocity with each other, contact at two points at the same time, a significant friction and slip occur at the surface of the gear on the moment. The friction greatly increases the necessary torque and the accompanied slip accelerates vibration, noise, and abrasion. A volume of the closed chamber formed between the both gears 26, 27 is strictly constant independent from the rotation angle. If there is no clearance CL and the fluid is divided into two chambers, a moment arises when the fluid is compressed and expanded in each closed chambers. This is called a block-in phenomenon. In this case, incompressible fluid cannot be utilized. Besides, a volatile liquid (various types of cooling medium) gives rise to cavitations when expanded. On the contrary, a block-in phenomenon does not occur and a stable pumping is possible for the incompressible fluid or the fluid having a possibility of cavitations by providing a clearance CL as illustrated.

Further, by providing a clearance CL, reverse liquid flowing is permitted inside the pump, so that an idling operation (rotation at zero flow) becomes possible in spite of the volume type pump. A pumping with which only a deference pressure is generated without generating a liquid flow is possible such as in the turbo type pump.

Here, the property of a volume type pump is preserved even when the clearance CL is provided. Because, pressure loss is generated due to viscosity of the liquid flowing through clearance CL, the pressure difference between the closed chambers is maintained by the pressure loss. The pressure difference is proportional to the cube of the clearance width, and is inversely proportional to Reynolds number (herein after referred to "Re" No., which is proportional to the number of revolution per unit time period and diameter of the trochoid gear, and is inversely proportional to the viscosity of the fluid). Therefore, the pump pressure can be maintained high if the size of the gear pump becomes smaller, even if the clearance becomes larger.

The optimal value of the clearance CL is decided as follows. In order to maintain the pump pressure at more than 100 or higher by a dimensionless number (the dimensionless number is given at zero flow by a pressure divided by the representative kinetic pressure of the pump; The representative kinetic pressure is given as fluid density multiplied by the square of representative velocity; The representative velocity is given as inner rotor base radius multiplied by the inner rotor angular velocity.), the clearance ratio to the inner rotor base radius (clearance ratio) is made 0.10 or less when Re=10, and 0.05 or less when Re>100.

Here, when the clearance is as low as less than 0.001, the pressure difference between two closed chambers on both sides of the clearance becomes 1000 or higher. At this time, if pressure variations arose independently in two closed chambers, the pressure does not spread if the difference is not higher than 1000. For this reason, there is a fear that if a block-in phenomenon arises, cavitations might occur or gears might be broken. Therefore, the clearance CL is set so that the clearance ratio becomes 0.001 or higher.

Figure 16:
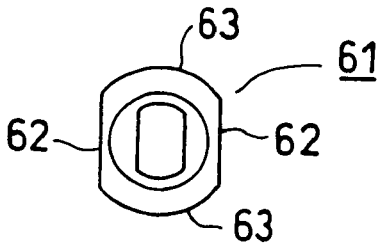
FIG. 16 is a plan view showing a shaft spacer shown in FIG. 2.
Figure 17:
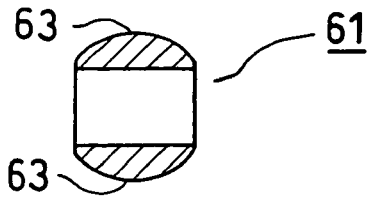
FIG. 17 is a cross section of the shaft spacer shown in FIG. 16.

The inner rotor 27 and the end of the rotation shaft 18 are coupled through a shaft spacer 61 as shown in FIG. 2. The shaft spacer 61 transmits the rotating force of the rotation shaft to the inner rotor 27, thereby controlling the attitude of the inner rotor 27. That is., the side surface of the shaft spacer 61 consists of parallel flat surfaces 62, 62, which transmit rotating force through contacting with the flat portion on the inner wall of the coupling hole 59 of the inner rotor 27, and a semispherical surfaces 63, 63, which connects the parallel flat surfaces 62, 62 and controls the attitude of the inner rotor 27 so that it is always rotated in a horizontal plain as shown in FIG. 16 and FIG. 17. More specifically, when the end of the rotation shaft 18 are coupled to the coupling hole 59 through the shaft spacer 61, the parallel flat surfaces 62, 62 on both sides of the shaft spacer 61 are in contact with the parallel flat surfaces on the inner wall of the coupling hole 59 as well as the semi-spherical surface 63, 63 are in contact with the curved inner surface 59*b* having a semisphere shape.

Here, amorphous carbon or resin material is used for the inner rotor 27, outer rotor 26 of the trochoid gear 25, or the contact portion of first bearing 19 and second bearing 20 with the rotation shaft 18, i.e. at least one of parts, which are frictionally in contact with each other.

Amorphous carbon is a non crystalline carbon, as is called as a glassy carbon, and has a property of low friction coefficient. Therefore, it exhibits a low friction coefficient without a lubricant, and it exhibits extremely low friction coefficient regardless of the sort of lubricant, when there exists a lubricant.

Also, a member made of amorphous carbon has a property of low friction coefficient. Namely, it hardly wears because of low friction coefficient, and the surface roughness is low even if it has been worn.

Further, the amorphous carbon has a low thermal expansion coefficient, a low bulk density, a high melting temperature or a heat deformation temperature, and high heat resistance.

Besides, the amorphous carbon has a property of light weight, high rigidity, non permeability against a liquid and a gas, high hardness, a compact homogeneous structure, high chemical resistant and no carbon falling, and thus it is suitable for a member, which is in sliding contact with other members.

Fluorocarbon resin such as tetrafluoroethylene is preferably used for the resin material constituting the first bearing 19 and the second bearing 20 other than the amorphous carbon. Polyethylethyl ketone, polyimide or fluorocarbon resins are used for the inner rotor 27 and the outer rotor 26 of the trochoid gear. These are materials excellent in sliding characteristics, wear resistance and chemical resistance.

The operation of the small size gear pump according to the embodiment described above will be explained below.

When a command for rotation to the flexible board 46 is given from outside, the stator 23 is excited, which gives magnetic rotating force to the rotor 22 across the bottom plate of the case 11 and rotates the rotor 22 and the rotation shaft 18 coupled with the rotor 22 around their axis. The rotation shaft 18 is then, supported in thrust direction by the first bearing 19 by a magnetic attracting force generated between the magnet 43 of the rotor 22 and the metal core board 44 of the stator 23. The rotation shaft 18 is also supported in radial direction at an outer periphery of its lower end by the first bearing 19 and at an outer periphery of its intermediate portion by the second bearing 20.

With the rotation of the rotation shaft 18, the trochoid gear 25 in the gear chamber 14 is driven to rotate, thereby the pump action being generated. With the pump action, a fluid is sucked into the case 11 through the pipe 15 and suction port 40. Having filled the rotor chamber 12, the fluid enters into the gear chamber 14 through the vertical communicating hole 50 of the bearing chamber 13. The fluid then enters into a space between the outer rotor 26 and the inner rotor 27 of the trochoid gear 25. With rotation and transportation by the trochoid gear 25, the fluid passes through the outside communicating hole (discharge port) 51 and is discharged from pipe 16.

As described above, a shaft spacer 61 is used for connecting the inner rotor 27 of the trochoid gear 25 and the rotation shaft 18, in which the inner rotor 27 is allowed to be tilted with respect to the rotation shaft 18. As the result, even if there were some error in the right angle between the gear chamber 14 and the rotation shaft 18, the inner rotor 27 can be rotated smoothly.

Namely, it is not easy to keep the gear chamber 14 in a horizontal plane, which is perfectly perpendicular to the axial direction of the rotation shaft 18 from the point of machining accuracy, and thus there are usually some angle differences from the right angle in practice. Consequently, if the rotation shaft 18 and the inner rotor 27 are tightly coupled with each other, sticking or scratching arises partly between the inner rotor 27 and inner surface of the gear chamber 14, or between the inner rotor 27 and the outer rotor 26, owing to the angle error. Thus smooth rotation of the rotors is impossible.

On the contrary, according to the above-mentioned embodiment, the inner rotor 27 is coupled loosely with the rotation shaft 18 through the shaft spacer 61 having a semi-spherical surface 63 (shown in FIG. 17) formed on the side of the shaft spacer 61. For this reason, the inner rotor 27 can be tilted according to the angle error of the gear chamber 14. Therefore, the sticking or scratching does not arise partly between the inner rotor 27 and inner surface of the gear chamber 14, or between the inner rotor 27 and the inner surface of the outer rotor 26. Thus a smooth rotation is assured.

Here, the flow pass of the fluid described above is formed in the case where the rotor 22 is rotated clockwise by the stator 23. However, the fluid flows in the opposite direction in the pass described above, when the rotor 22 is rotated counter-clockwise by inverting the polarity of the electric power supplied to the stator 23. In that case, the pipe 16 and the vertical communicating hole 50 acts as the suction port. The fluid enters into the gear chamber 14 through the outside communicating hole 51, and flows into the rotor chamber 12 through the vertical communicating hole 50. The fluid is then discharged outside from the communicating path 40 and the pipe 15, which act as a discharge port.

The fluid sucked in the case 11 fills the rotor chamber 12, and enters into the portion between the first bearing 19 and the outer periphery of the lower end of the rotation shaft 18. The fluid also enters into the portion between the first bearing 19 and the lower surface 22*a* of the rotor 22 integrally connected to the rotation shaft 18 (shown in FIG. 5). Namely, the fluid enters into sliding portions by capillary phenomenon. Further, the fluid enters into the portion between the second bearing 20 provided on the bearing 13 and the outer periphery of the rotation shaft 18 (the sliding portion) by capillary phenomenon.

Here, amorphous carbon or resin material is used at the portions (the sliding portion) of the first bearing 19 and the second bearing 20, which are in contact with the rotation shaft 18.

Because an amorphous carbon has high wear resistance, low friction property called as self lubrication characteristics as mentioned above, it provides a smooth sliding support for the moving members such as a rotation shaft without using lubricants, when it is used for such a sliding members as bearings. Thus, a support unit such as a bearing can be obtained, which has a simple structure without using lubricants. Durability of the support unit itself can be increased.

Because the amorphous carbon has a high chemical resistance, chemical change by reaction does not occur even if it is provided in a space where fluid is contained (the rotor chamber 12 or the bearing chamber 13 in the above embodiment). For example, even if the fluid is such chemically active one as a strong acidic or a strong alkaline, the sliding member cannot be damaged by fluid when amorphous carbon is used as sliding members. Thus the function of the sliding members can be maintained long, and the fluid can be used as a lubricant.

Thus, when sliding members are provided in the fluid path, fluid enters between such a moving member as a rotation shaft and such a sliding member as a bearing by the capillary phenomenon. The sliding members made of amorphous carbon can use various sorts of fluid as lubricant, different from the case of sliding members made of metal etc., where the kinds of lubricant are limited. Although the amorphous carbon does not need lubricant as described above, a smoother support is possible by the existence of the lubricant.

Because the amorphous carbon or the resin material is used as sliding member for the first bearing 19 and the second bearing 20 in the above embodiment, the chemical change does not occur due to the chemical resistance of the amorphous carbon and the fluid functions as lubricant, even if liquid ammonia and the like is used as a fluid, thereby maintaining the function of a sliding member in the bearings 19 and 20 for long time.

The outer rotor 26 and inner rotor 27 of the trochoid gear 25 use the amorphous carbon as their structural material. The outer rotor 26 and the inner rotor 27 generate a pump function for liquid ammonia sliding on each other when they are rotating. In this case, the liquid ammonia plays a lubricant role at the same time for the sliding portion and can maintain the function as a pump member for a long time.

Here, it is preferable to use fluorocarbon elastmeric adhesive for adhering and fixing the amorphous carbon member in the first bearing 19 and the second bearing 20.

Here, a metal, ceramics, or resin can be used for a material constructing the case 11, by selecting it with an appropriate considering the chemical properties of the fluid.

For example, if the liquid ammonia is used as the flowing fluid, the liquid reacts sensitively with the temperature variation, and a considerable pressure is generated by the inside pump function. Therefore, members for the case to which a high pressure is applied, such as motor case 30, bearing case 31, gear case 32, and upper lid 33 should be strongly and firmly constructed.

Therefore, it is preferable for the case member described above to use a copper free high permeability high strength steel, which is provided by adding niobium, aluminum, titan to a nickel base alloy including nickel, chromium, iron or molybdenum as a major component and which has a precipitation hardening feature.

Further, a copper free high permeability high strength steel, which is a titan base alloy material including titan, aluminum, vanadium as the major component, may be used as the pressure tight member for the case.

Further, a high permeable and a high strength steel may be used as a pressure tight member for the case, which is a an aluminum base alloy made in such manner that a powder material consisting of an aluminum base alloy including aluminum and iron as the major component added by silicon, vanadium, zirconium, molybdenum, magnesium etc. is solidified with a rapid cool solidifying method such as PM method or SF method.

The motor case 30, the bearing case 31, the gear case 32, and the upper lid 33, which compose the case 11, are connected integrally by bolts (not illustrated) in vertical direction with a plurality of O-rings 38 being interposed between any two of them. It is preferable that the O-rings 38 are made of silicone or fluorocarbon elastmeric resin.

Gaskets made of a resin or a metal may be used instead of the O-rings for the portions where seal is necessary.

Further, when the stator 23 is assembled on the lower surface of the case 11, a reinforcing plate 47 is assembled on the lower surface of the metal core board 44 of the stator 23. The strength of the case 11 is much increased by fastening the reinforcing board 47 together with the metal core board 44 and to make use of the reinforcing board 47 as a bottom plate of the case 11.

What is claimed is:

1. A small size gear pump comprising:

a disc-shaped case having a motor rotor chamber, a bearing chamber and a gear chamber piled sequentially and being communicated with each other, a suction port connected to the rotor chamber communicating with outside, a discharge port connected to the gear chamber communicating with outside, a rotation shaft having an end positioned in the motor rotor chamber and the other end extending to the gear chamber, a motor rotor fixed around the rotation shaft in the motor rotor chamber, a first bearing provided in the motor rotor chamber for supporting the end of the rotation shaft in radial and thrust directions, a second bearing provided in the bearing chamber for supporting an intermediate portion of the rotation shaft in the radial direction, a stator on the outer surface of a bottom of the motor rotor chamber, wherein the stator and the motor rotor are part of a motor;

an outer rotor provided in rotary fashion in the gear chamber, and an inner rotor connected with the other end of the rotation shaft, wherein the inner and outer rotors are part of a trochoid gear, a vertical communicating hole provided in the bearing chamber for connecting the rotor chamber with the gear chamber, an outside communicating hole provided in the bearing chamber for connecting the gear chamber with the discharge port, first and second arc-shaped concave portions provided on upper ends of the vertical communicating hole and the outside communication hole, wherein a fluid is introduced through the suction port, vertical communicating hole and a first one of the arc-shaped concave portions into the gear chamber and is discharged from the discharge port through the outside communication hole and a second one of the arc-shaped concave portions by rotation of the trochoid gear.

2. A small size gear pump according to claim 1, wherein the first bearing comprises a radial bearing portion consisting of a concave portion, which is provided in the motor rotor chamber and in which the end of the rotation shaft is inserted, and a thrust bearing portion formed on a surface around the concave portion for contacting with an under surface of a center portion of the motor rotor around the axis of the rotation shaft and for rotating them thereon.

3. A small size gear pump according to claim 2, wherein a shaft spacer having a cross section larger than that of the rotation shaft and having a flat side surface and a curved side surface is integrally provided on the other end of the rotation shaft extending to the gear chamber, wherein a coupling hole for inserting the shaft spacer is provided at a center portion of the inner rotor, and wherein the rotating force of the rotation shaft is transmitted to the inner rotor and an attitude of the rotating inner rotor is controlled by the coupling hole and the shaft spacer.

4. A small size gear pump according to claim 3, wherein the flat side surface transmits the rotating force to the inner rotor and the curved side surface is projecting outward of the flat side of the rotation shaft.

5. A small size gear pump according to claim 1, wherein the case is composed of a motor case, bearing case and a gear case, the motor case having a flat and cylindrical concave portion used for a rotor chamber is provided on an upper surface of the motor case, having a first bearing provided at a central portion of a bottom of the motor case, and a concave portion for mounting the stator is provided on outer surface of the bottom, the bearing case is assembled integrally on the motor case through a seal member and having a second bearing which is coaxial with the first bearing, which is provided at a center portion of the bearing case, and the gear case being assembled integrally on the bearing case through a seal member, having a flat and cylindrical opening, which is penetrating vertically and has an eccentric center axis with the rotor chamber, and having an upper lid which is assembled on the gear case integrally through seal member for covering the upper surface of the gear chamber.

6. A small size gear pump according to claim 5, wherein the first bearing comprises a radial bearing portion consisting of a concave portion, which is provided in the motor rotor chamber and in which the end of the rotation shaft is inserted, and a thrust bearing portion formed on a surface around the concave portion for contacting with an under surface of a center portion of the motor rotor around the axis of the rotation shaft and for rotating them thereon.

7. A small size gear pump according to claim 6, wherein a shaft spacer having a cross section larger than that of the rotation shaft and a curved outer side, is integrally provided on the other end of the rotation shaft extending to the gear chamber, wherein a coupling hole for receiving the shaft spacer is provided at a center portion of the inner rotor, and wherein the rotating force of the rotation shaft is transmitted to the inner rotor and an attitude of the rotating inner rotor is controlled by the coupling hole and the shaft spacer.

8. A small size gear pump according to claim 7, wherein the outer side has a flat portion formed on at least a surface for transmitting the rotating force to the inner rotor and a projecting curved surface formed on a portion other than the flat portion.

9. A small size gear pump according to claim 8, wherein the shaft spacer is in contact with an inner surface of the coupling hole at the flat portion and the curved surface.

10. A small size gear pump according to claim 9, wherein the flat portion formed on the outer surface is a pair of parallel side surfaces facing with each other and the projecting curved surface is a curved surface connecting the parallel side surfaces.

11. A small size gear pump according to claim 10, wherein the curved surface is substantially a hemisphere.

12. A small size gear pump according to claim 11, wherein the stator is provided with a metal core board and the rotation shaft is pulled toward the thrust direction by a magnetic attraction force produced between the metal core and magnet of the rotor.

13. A small size gear pump according to claim 12, wherein the first bearing or the second bearing is a sliding bearing.

* * * * *